US012098896B1

(12) United States Patent
Noonan

(10) Patent No.: US 12,098,896 B1
(45) Date of Patent: Sep. 24, 2024

(54) ASSEMBLY

(71) Applicant: Paul T. Noonan, Boise, ID (US)

(72) Inventor: Paul T. Noonan, Boise, ID (US)

( * ) Notice: Subject to any disclaimer, the term of this patent is extended or adjusted under 35 U.S.C. 154(b) by 0 days.

(21) Appl. No.: 18/111,098

(22) Filed: Feb. 17, 2023

Related U.S. Application Data

(60) Provisional application No. 63/312,005, filed on Feb. 19, 2022.

(51) Int. Cl.
*F41A 19/34* (2006.01)
*F41A 17/72* (2006.01)

(52) U.S. Cl.
CPC ..... *F41A 19/34* (2013.01); *F41A 17/72* (2013.01)

(58) Field of Classification Search
CPC ..... F41A 19/34; F41A 17/72
USPC ..... 42/69.01
See application file for complete search history.

(56) References Cited

U.S. PATENT DOCUMENTS

| | | | | |
|---|---|---|---|---|
| 3,780,618 | A * | 12/1973 | Sanford | F41A 17/56 89/169 |
| 6,609,319 | B1 * | 8/2003 | Olson | F41A 15/14 89/185 |
| 9,488,423 | B2 * | 11/2016 | Sullivan | F41A 13/12 |
| 10,969,183 | B2 * | 4/2021 | Gibbens | F41A 19/13 |
| 2010/0313459 | A1 * | 12/2010 | Gomez | F41A 17/72 42/70.08 |
| 2014/0259842 | A1 * | 9/2014 | Feese | F16F 1/36 42/25 |

FOREIGN PATENT DOCUMENTS

| | | | | |
|---|---|---|---|---|
| WO | WO-2007111577 | A2 * | 10/2007 | F41A 17/72 |

* cited by examiner

*Primary Examiner* — John Cooper

(57) ABSTRACT

An assembly and a method are disclosed. The assembly contains an extractor pin containing a channel, and a firing pin spring configured to accommodate a firing pin, wherein the channel is configured to accommodate the firing pin spring.

5 Claims, 22 Drawing Sheets

ASSEMBLY

CROSS REFERENCE TO RELATED APPLICATIONS

This application claims the benefit of U.S. Provisional Application No. 63/312,005, filed on Feb. 19, 2022, which is incorporated herein by reference in its entirety.

FIELD

The present invention relates to an extractor pin. More particularly, the present invention relates to an extractor pin having a channel.

BACKGROUND

Numerous firing pin safety devices have been developed and implemented over the years with a varying degree of success. These safety devices have the general purpose of preventing the unintentional discharge of a firearm should the weapon be violently struck from the front (for example, if the firearm accidentally falls on the group causing the muzzle of the weapon to strike a potentially hard surface), or should debris become wedged between the firing pin and its housing causing the firing pin to be stuck in the firing or primed position.

Firing pins that do not have any mechanical means preventing the tip from contacting the primer of a cartridge, are common in both the M16 and AK family of firearms. When a hammer strikes the rear end of the firing pin, its energy is transferred to the firing pin which responds by moving forward and striking the primer of the loaded cartridge being held by the barrel's chamber.

Unfortunately, kinetic energy may also be imparted to a firing pin unintentionally such as when a weapon is dropped by the user accidentally. Another possibility, when the action of the firearm is released after being drawn fully to the rear, upon seating the firing pin, due to inertia, is still traveling forward only stopping after it strikes the primer of the loaded cartridge. This often leads to a small dimple of the primer's surface. These provided examples, under the right circumstance, could cause a weapon to accidentally discharge.

Therefore, a need exists for a better type of an assembly configured to prevent accidental discharges.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

As described herein, the term "pivotally connected" shall be used to describe a situation wherein two or more identified objects are joined together in a manner that allows one or both of the objects to pivot, and/or rotate about or in relation to the other object in either a horizontal or vertical manner.

As described herein, the term "removably coupled" and derivatives thereof shall be used to describe a situation wherein two or more objects are joined together in a non-permanent manner so as to allow the same objects to be repeatedly joined and separated.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 1:
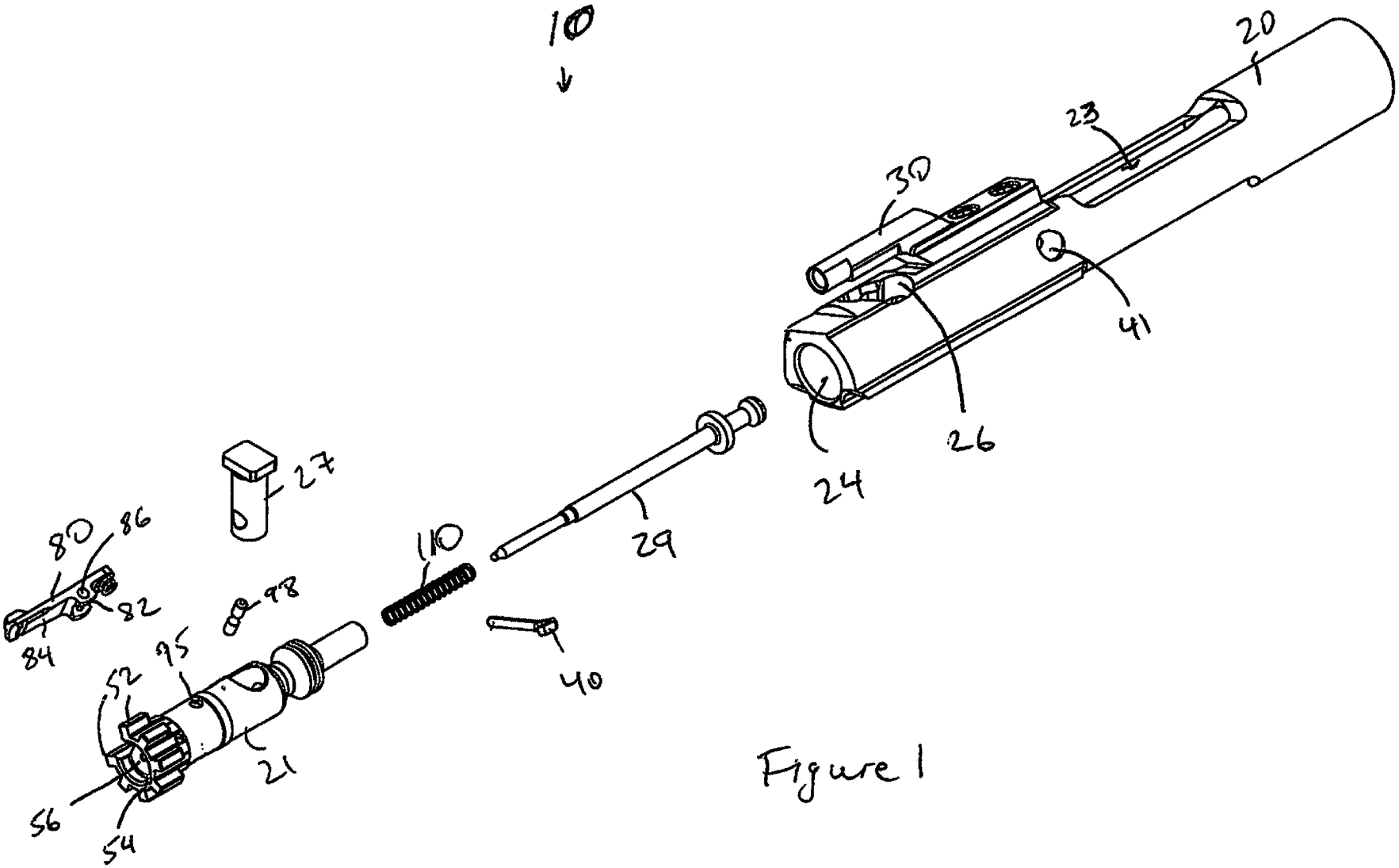
FIG. 1 depicts an exploded view of an assembly according to some embodiments presently disclosed.
Figure 2:
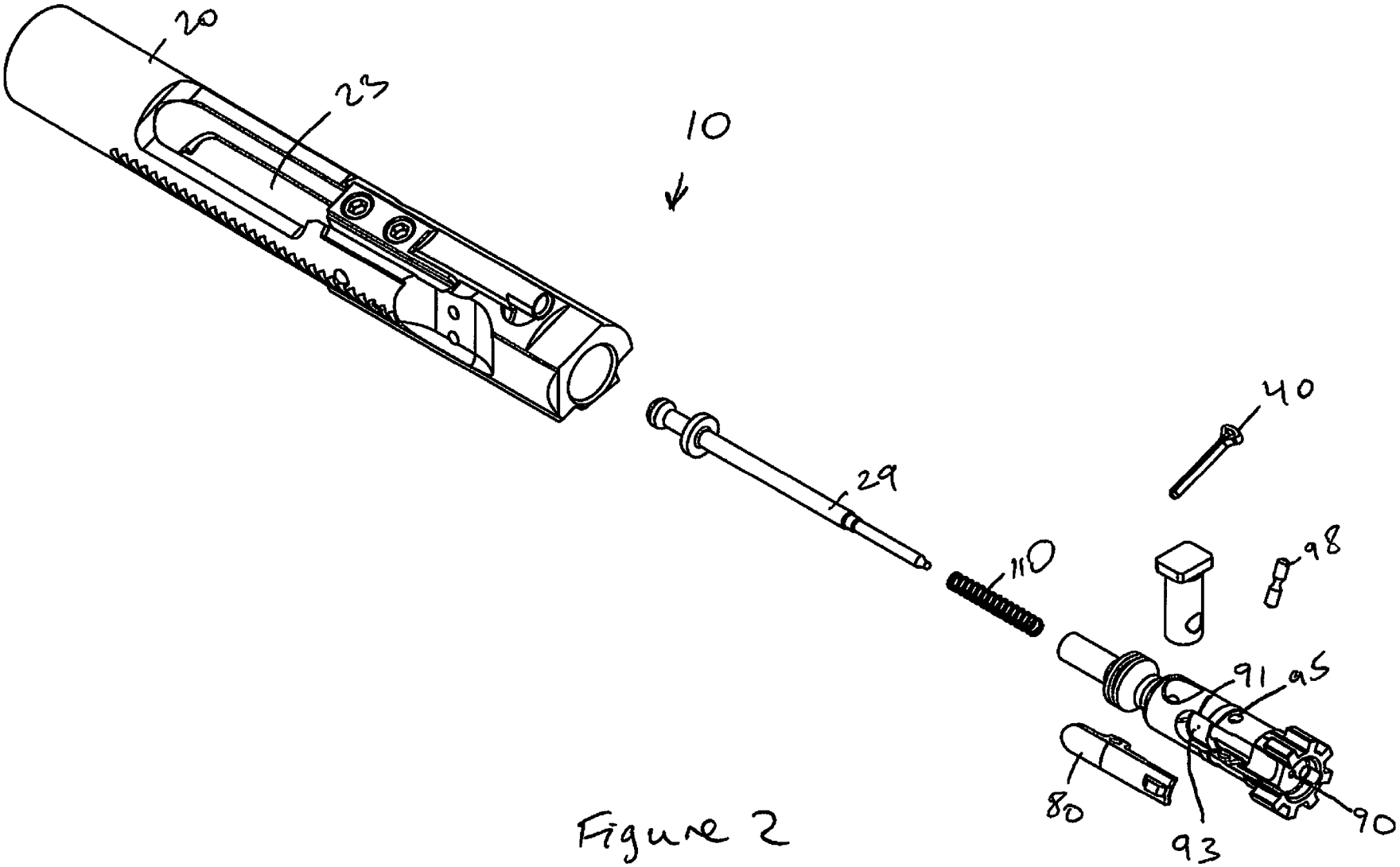
FIG. 2 depicts another exploded view of the assembly according to some embodiments presently disclosed.

FIGS. 1 and 2 depict an explode view of a bolt carrier assembly 10 according to some embodiments presently disclosed. The bolt carrier assembly 10 is responsible for stripping, chambering, locking, firing, extraction and ejection of ammunition cartridges for the host rifle. According to some embodiments, the energy to perform these functions may be provided in the form of hot, expanding gases which travel through the host firearm's gas tube, through the gas key and into the bolt carrier. It is to be understood that the bolt carrier assembly 10 may be employed with any of the various direct gas operated M16 type firearms; however with minor modifications, some of its features could be more widely used for other firearms as well. It is to be also understood that at least some of the features of the bolt carrier assembly 10 are capable of being adapted to work with most direct and indirect (piston operated) gas operated firearms. It is to be also understood that at least some of the features of the bolt carrier assembly 10 are capable of being adapted to work with blowback operated firearms. The bolt carrier assembly 10 is housed within an upper receiver (not shown) that is removably coupled with a lower receiver 22 shown in FIGS. 17-20.

Figure 3:
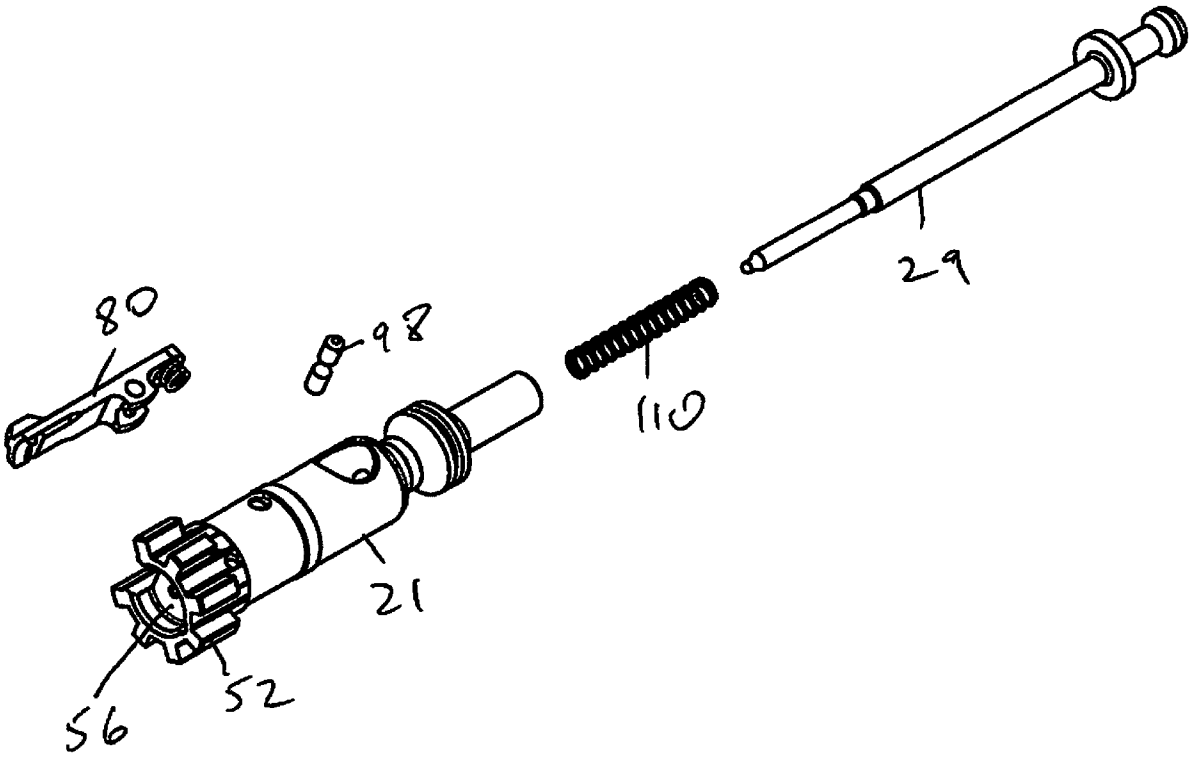
FIG. 3 depicts another exploded view of an assembly according to some embodiments presently disclosed.

The bolt carrier assembly 10 may comprise a bolt carrier 20 and a bolt 21 (shown in FIG. 3). The bolt carrier 20 may comprise a hammer clearance slot 23, which permits a hammer 31 (shown in FIGS. 17-20) to extend into the bolt carrier 20 and strike a firing pin 29 (shown in FIGS. 18 and 20). The bolt carrier 20 may also comprise an opening 41 for a cotter pin 40 and an opening 24 for the bolt 21. The bolt carrier assembly 10 may also comprise a gas key 30. According to some embodiments, the hammer 31 may strike a firing pin 290 (shown in FIG. 10)

The bolt carrier 20 may also comprise a cam slot 26 which provides a contained area for a cam pin 27 to rotate, thus allowing the bolt 21 to move rearward and rotate axially within the bolt carrier 20. The cam pin 27 retains the bolt 21 within the bolt carrier 20.

According to some embodiments, the bolt 21 may comprise a cartridge extractor 80, one or more lugs 52, a breech face 54, and/or a cartridge seat 56. According to some embodiments, the bolt 21 comprises a firing pin aperture 90 (shown in FIGS. 2 and 15-16) through which a firing pin 29 may protrude to ignite primer in a cartridge seated in the cartridge seat 56.

Figure 11:
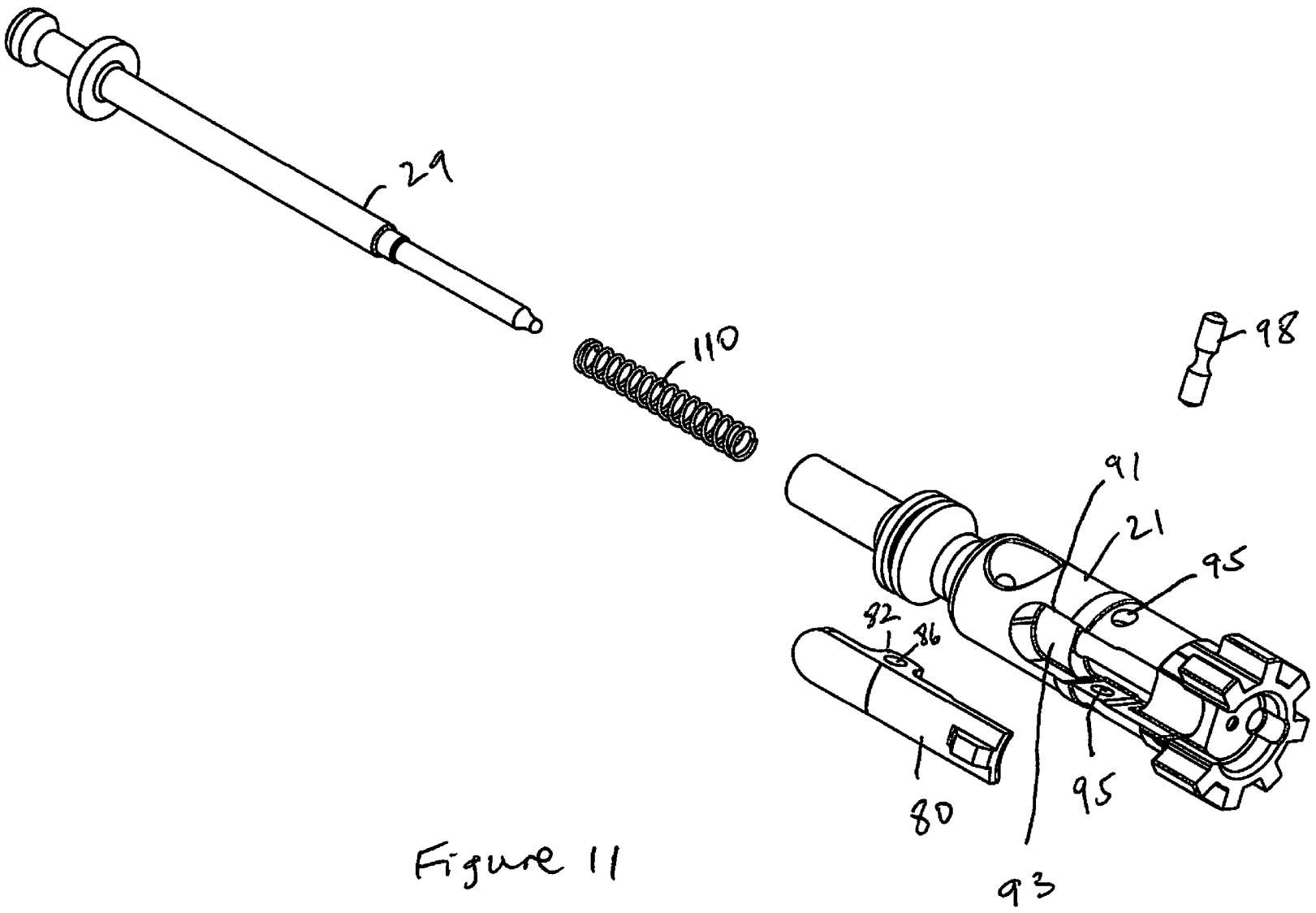
FIG. 11 depicts another assembly according to some embodiments presently disclosed.

According to some embodiments, the bolt 21 comprises an extractor channel 91 (shown in FIG. 11). The extractor channel 91 comprises a seat 93 and a pin hole 95 (shown in FIG. 11). The pin hole 95 is configured to accommodate a pin 98 (shown in FIG. 11) that rotatably attaches the extractor 80 with the bolt 21.

According to some embodiments, the cartridge extractor 80 comprises a flange or housing 82 formed on and/or coupled to a bottom surface 84 (shown in FIG. 1). The housing 82 comprising and/or defining a pin hole 86 (shown in FIG. 1). The pin hole 86 may, for example, be disposed, configured, and/or oriented to accept the pin 98.

Figure 15:
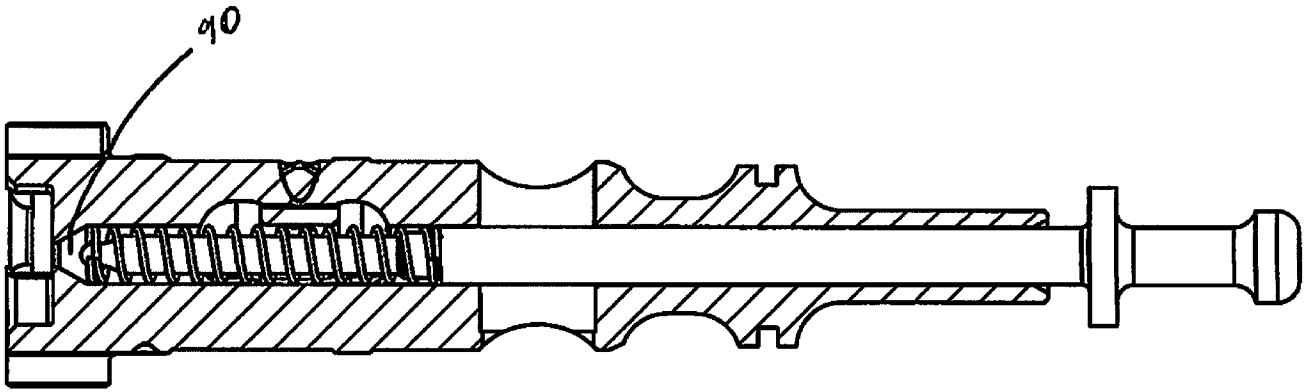
FIG. 15 depicts a cut away view of an assembly according to some embodiments presently disclosed.
Figure 16:
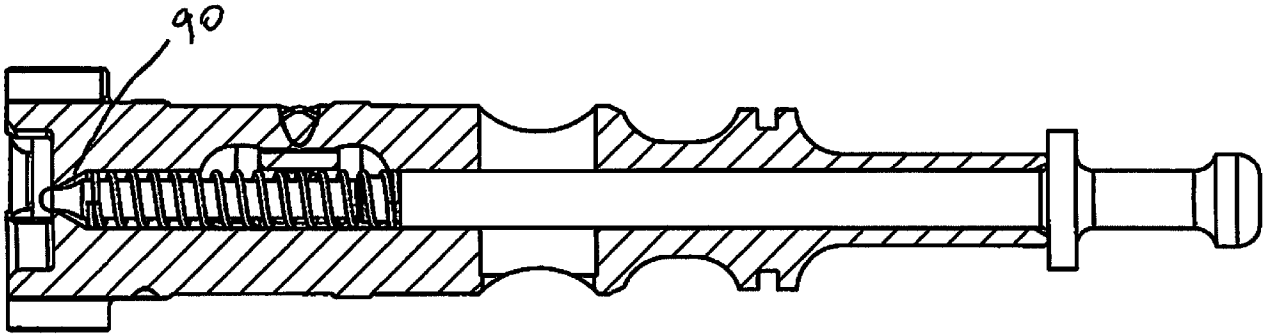
FIG. 16 depicts another cut away view of an assembly according to some embodiments presently disclosed.
Figure 17:
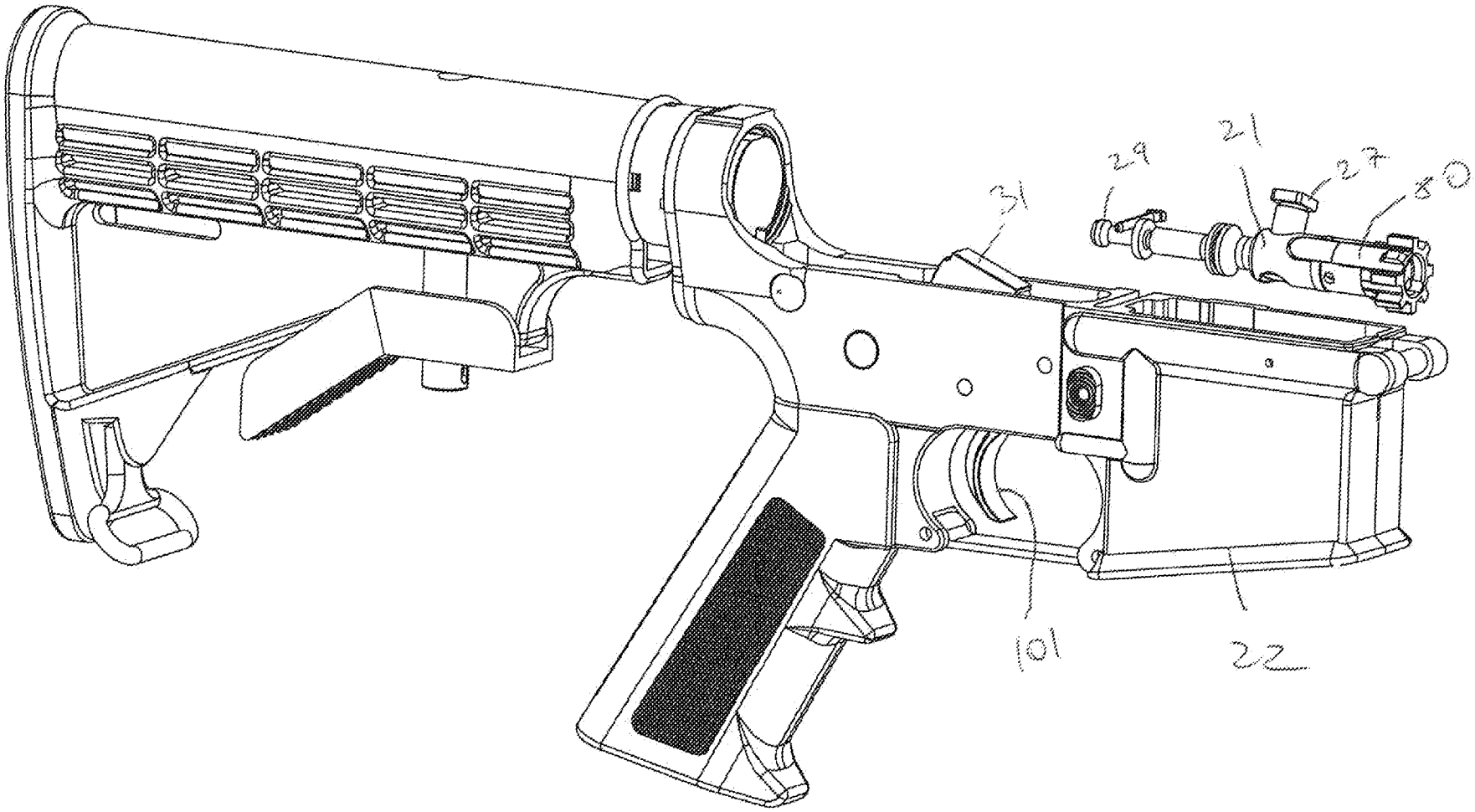
FIG. 17 depicts a partial view of a firearm according to some embodiments presently disclosed.

According to some embodiments, the bolt carrier assembly 10 comprises a firing pin spring 110 (shown in FIGS. 1-2 and 11). The firing pin spring 110 is configured to accommodate the firing pin 29 (shown in FIGS. 5-6 and 15-16). According to some embodiments, the firing pin aperture 90 is configured to accommodate the firing pin spring 110 and the firing pin 29 as shown in FIGS. 15-16. According to some embodiments, the firing pin 29 is rearwardly biased away from the cartridge seat 56 by the firing pin spring 110. According to some embodiments, the firing pin spring 110 is mounted between the firing pin aperture 90 and the firing pin 29 as shown in FIGS. 15-16.

Figure 10:
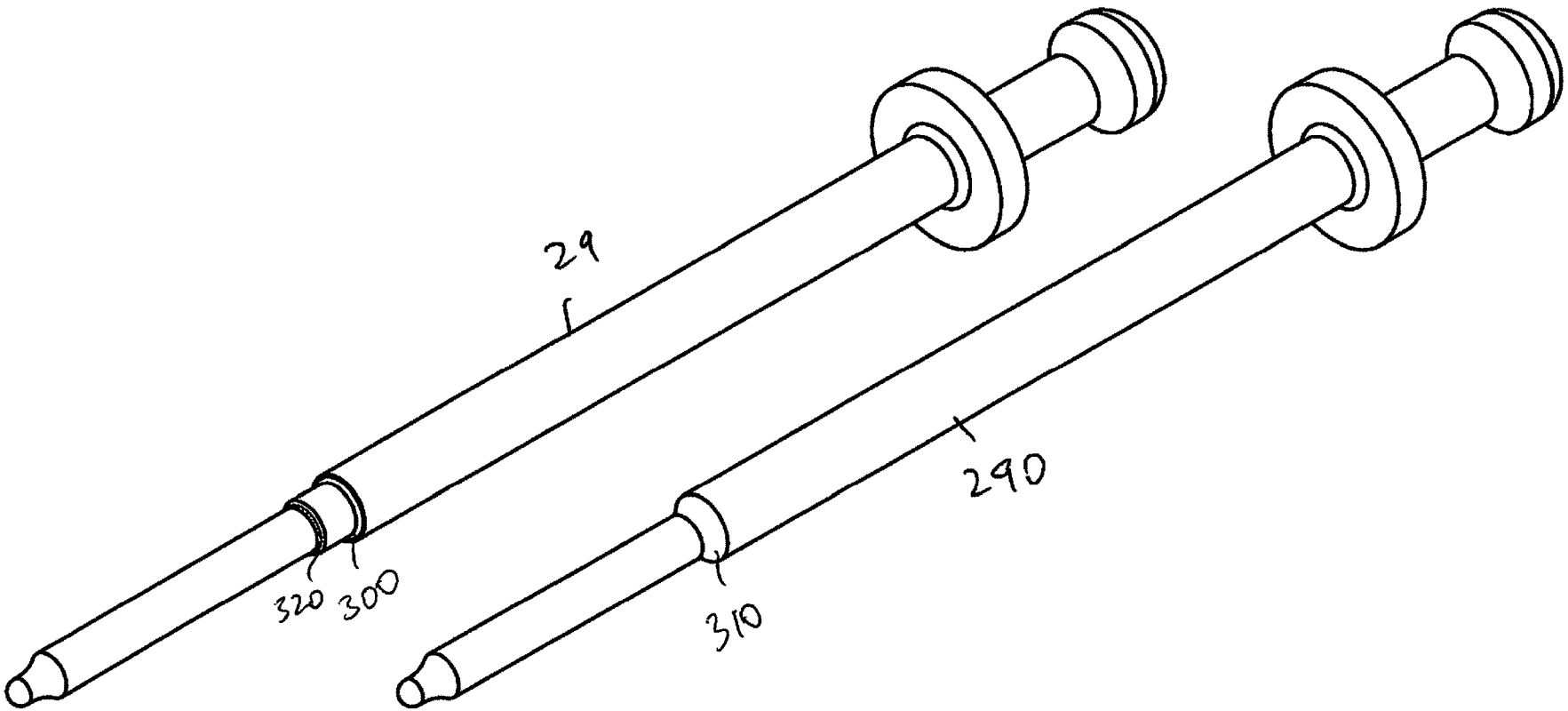
FIG. 10 depicts another perspective view of firing pins according to some embodiments presently disclosed.

According to some embodiments, the firing pin aperture 90 is configured to accommodate the firing pin spring 110 and the firing pin 290 as shown in FIG. 10. According to some embodiments, the firing pin 290 is rearwardly biased away from the cartridge seat 56 by the firing pin spring 110. According to some embodiments, the firing pin spring 110 is mounted between the firing pin aperture 90 and the firing pin 290 as shown in FIGS. 15-16.

Figure 4:
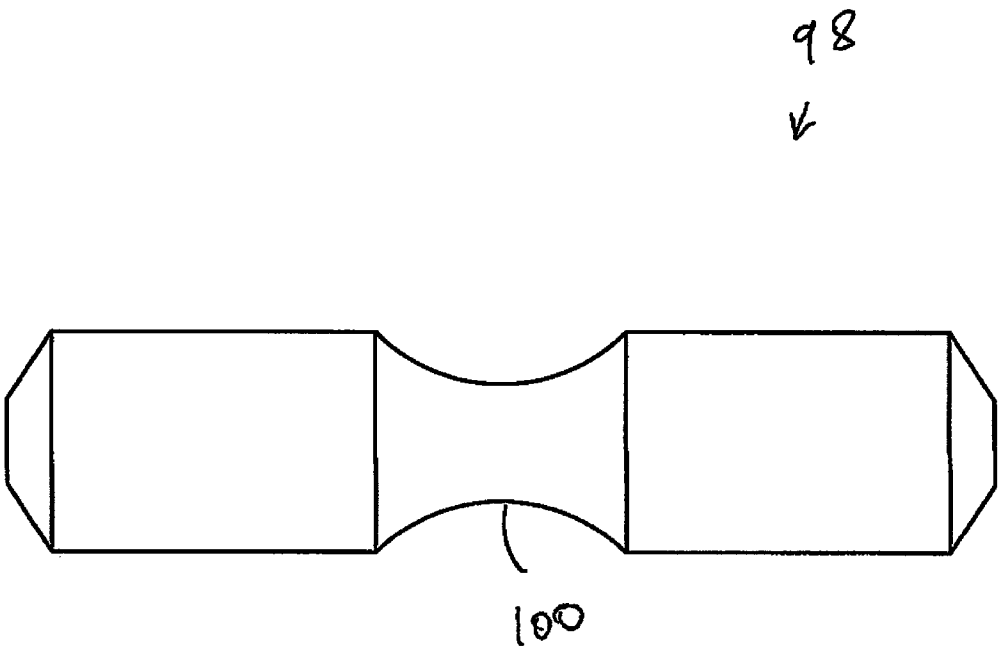
FIG. 4 depicts a pin according to some embodiments presently disclosed.
Figure 5:
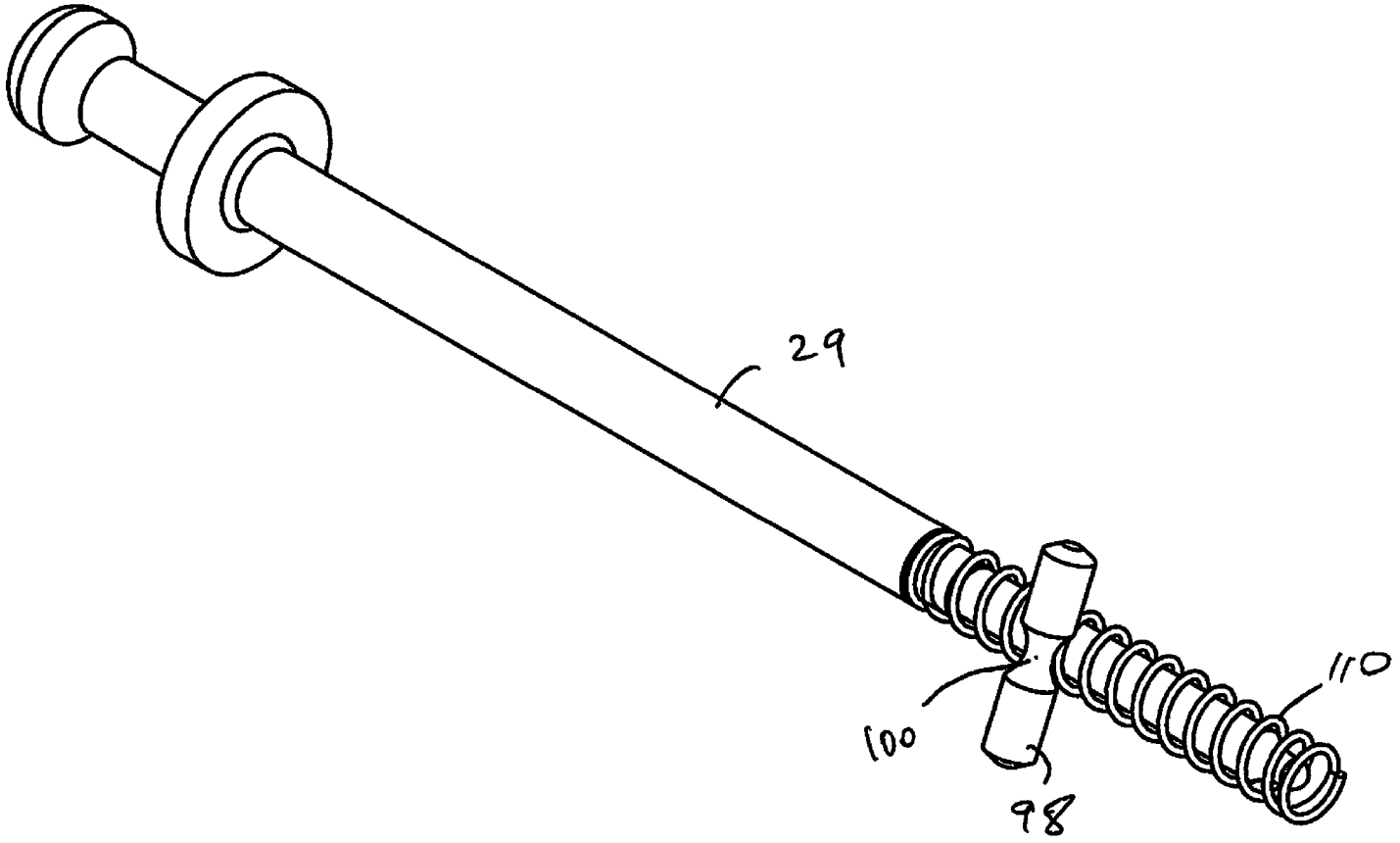
FIG. 5 depicts an assembly according to some embodiments presently disclosed.
Figure 6:
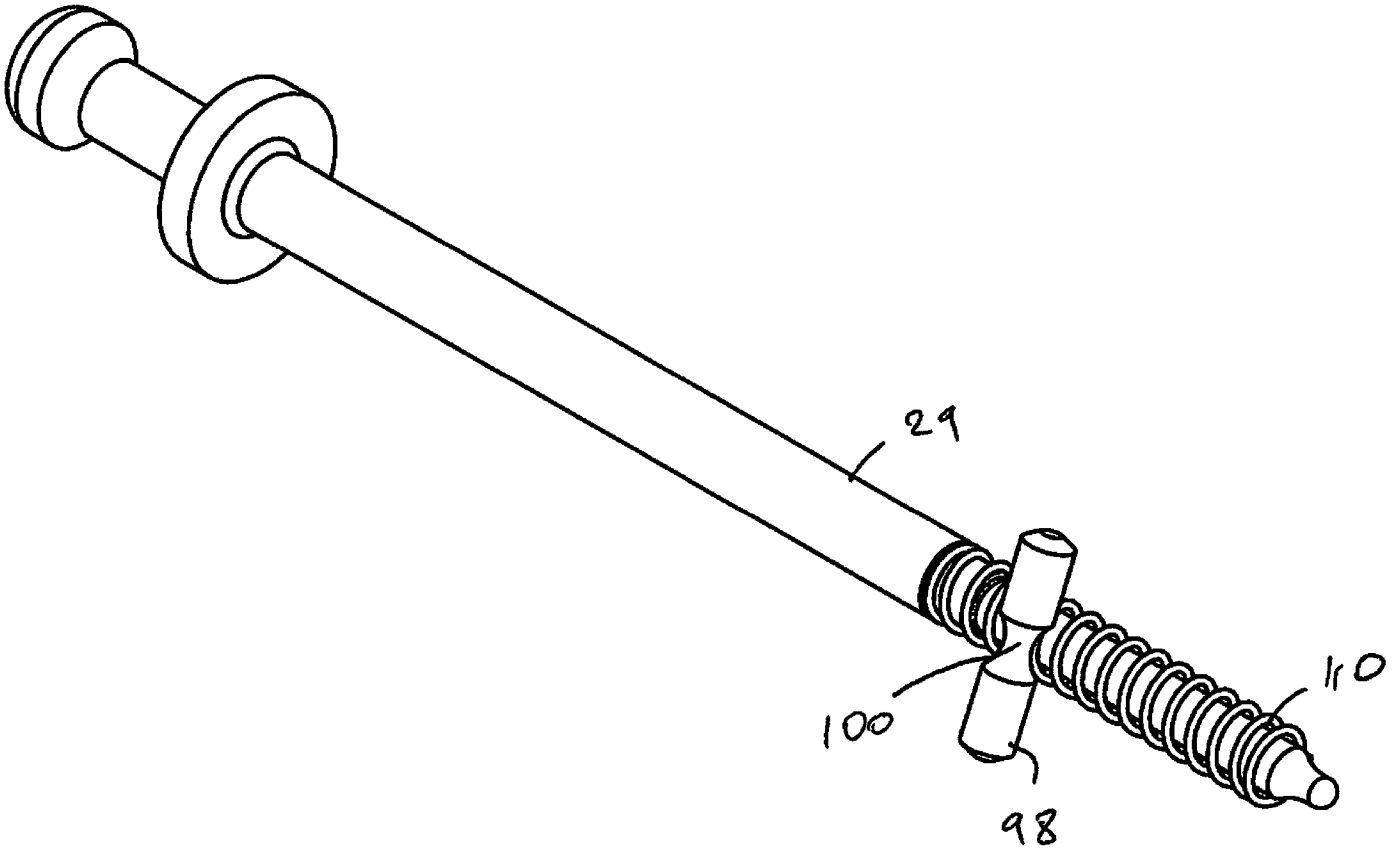
FIG. 6 depicts an assembly according to some embodiments presently disclosed.
Figure 7:
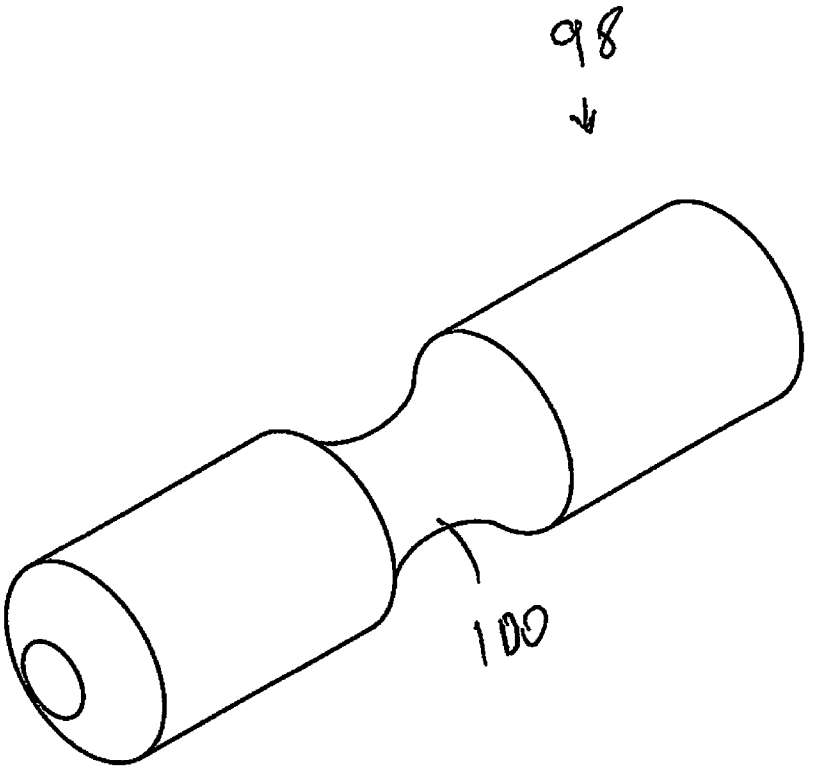
FIG. 7 depicts another view of the pin according to some embodiments presently disclosed.
Figure 12:
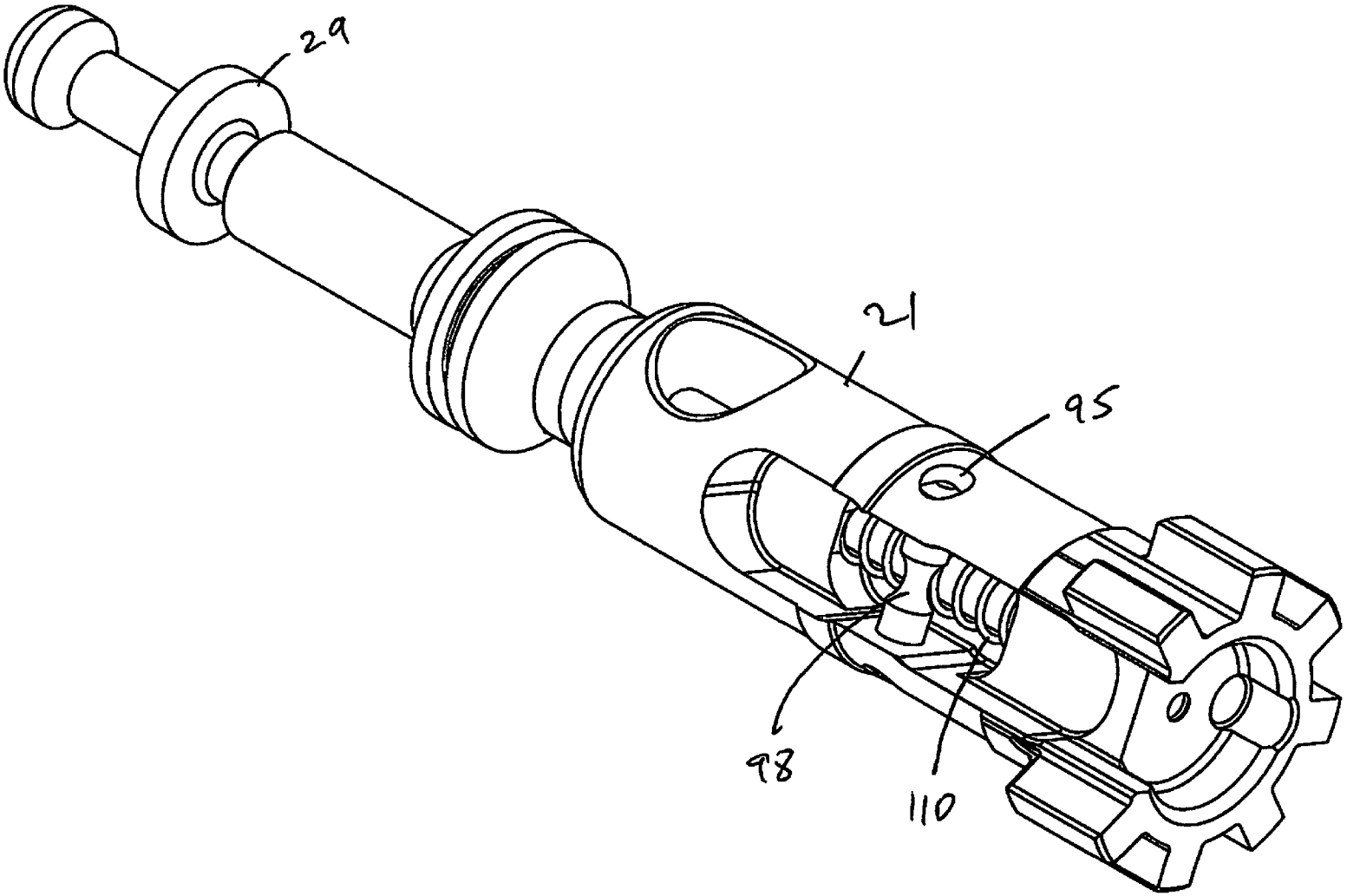
FIG. 12 depicts an assembly according to some embodiments presently disclosed.
Figure 13:
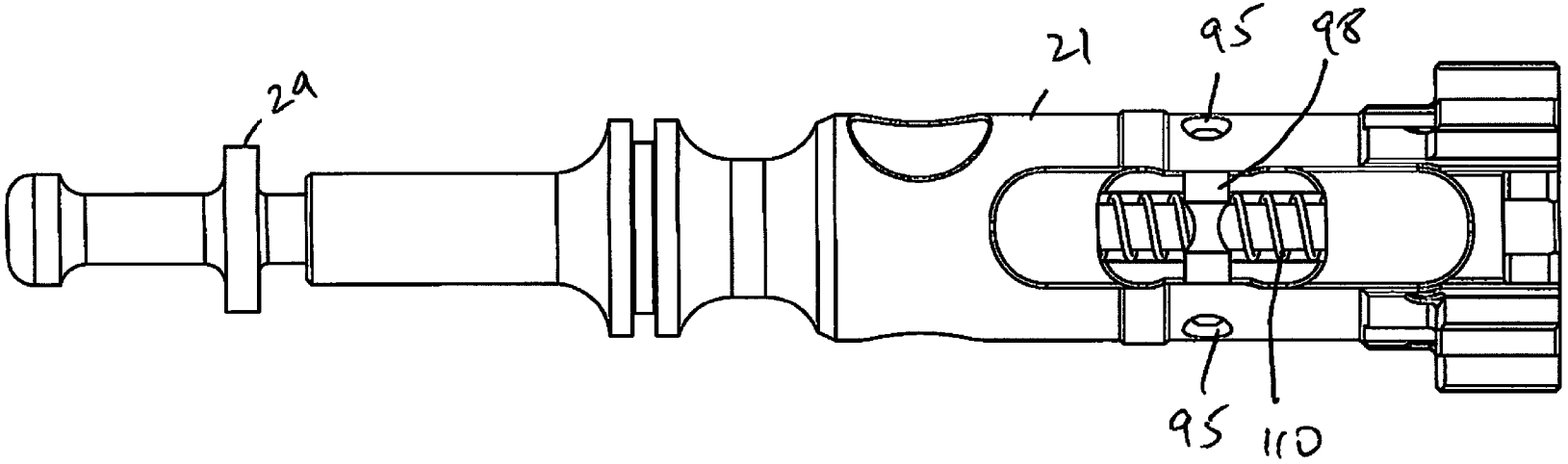
FIG. 13 depicts an assembly according to some embodiments presently disclosed.
Figure 14:
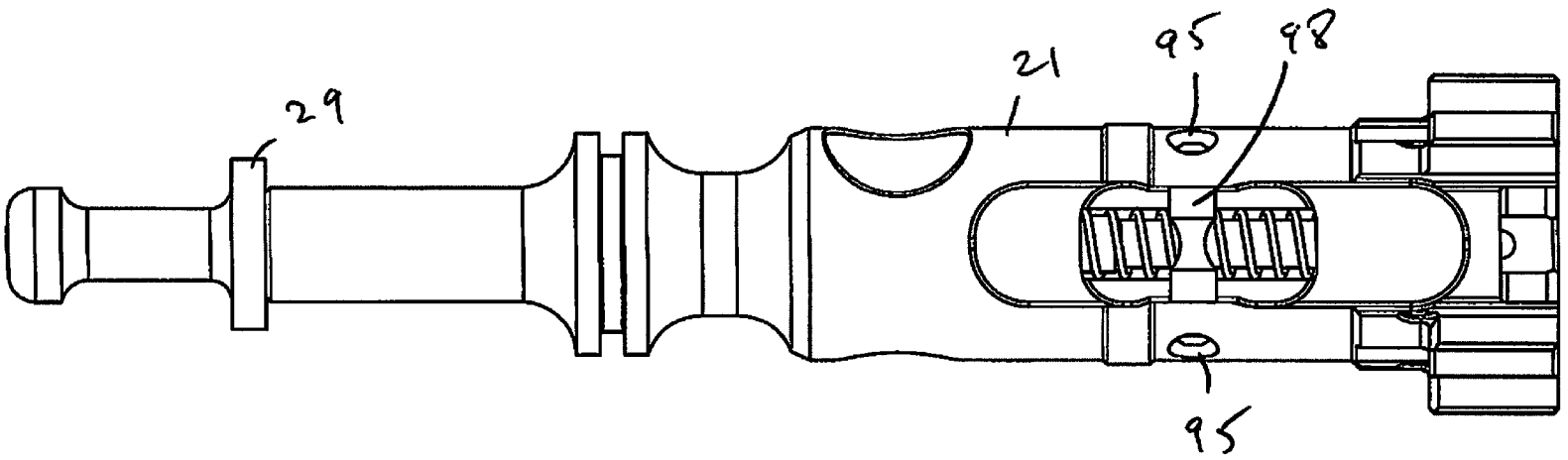
FIG. 14 depicts an assembly according to some embodiments presently disclosed.

According to some embodiments, the pin 98 comprises a channel 100 as shown in FIGS. 4 and 7. According to some embodiments, the channel 100 is positioned in the middle of the pin 98 as shown in FIGS. 4 and 7. According to some embodiments, the channel 100 is configured to accommodate the firing pin spring 110 as shown in FIGS. 5-6, 12-14 and 21. According to some embodiments, the channel 100 is configured to allow the firing pin spring 110 to be compressed by the movement of the firing pin 29 as shown in FIGS. 13-14. For ease of references, the bolt 21 is shown in FIGS. 12-14 without the cartridge extractor 80 and with pin 98 in the pin hole 95.

Figure 18:
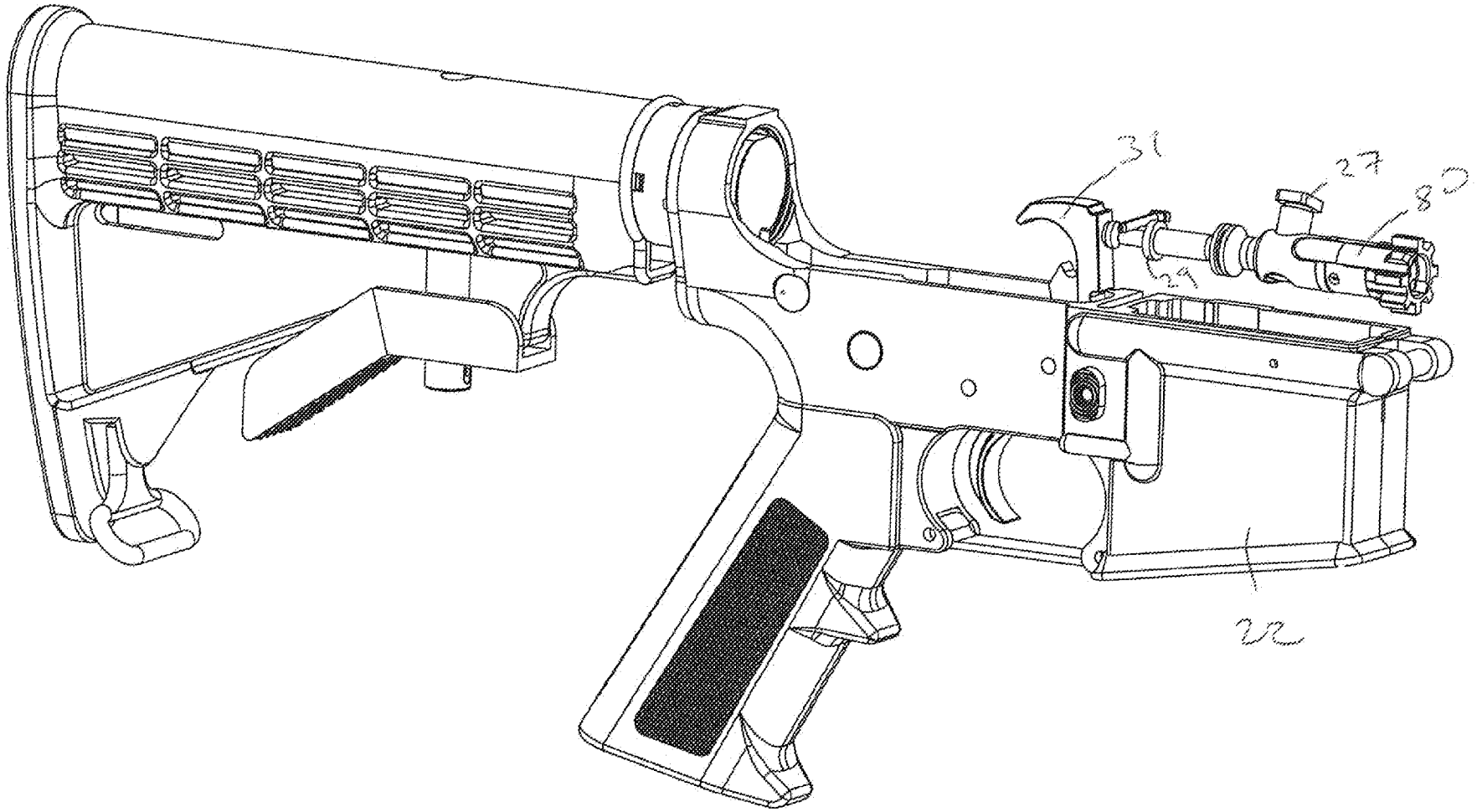
FIG. 18 depicts another partial view of a firearm according to some embodiments presently disclosed.
Figure 19:
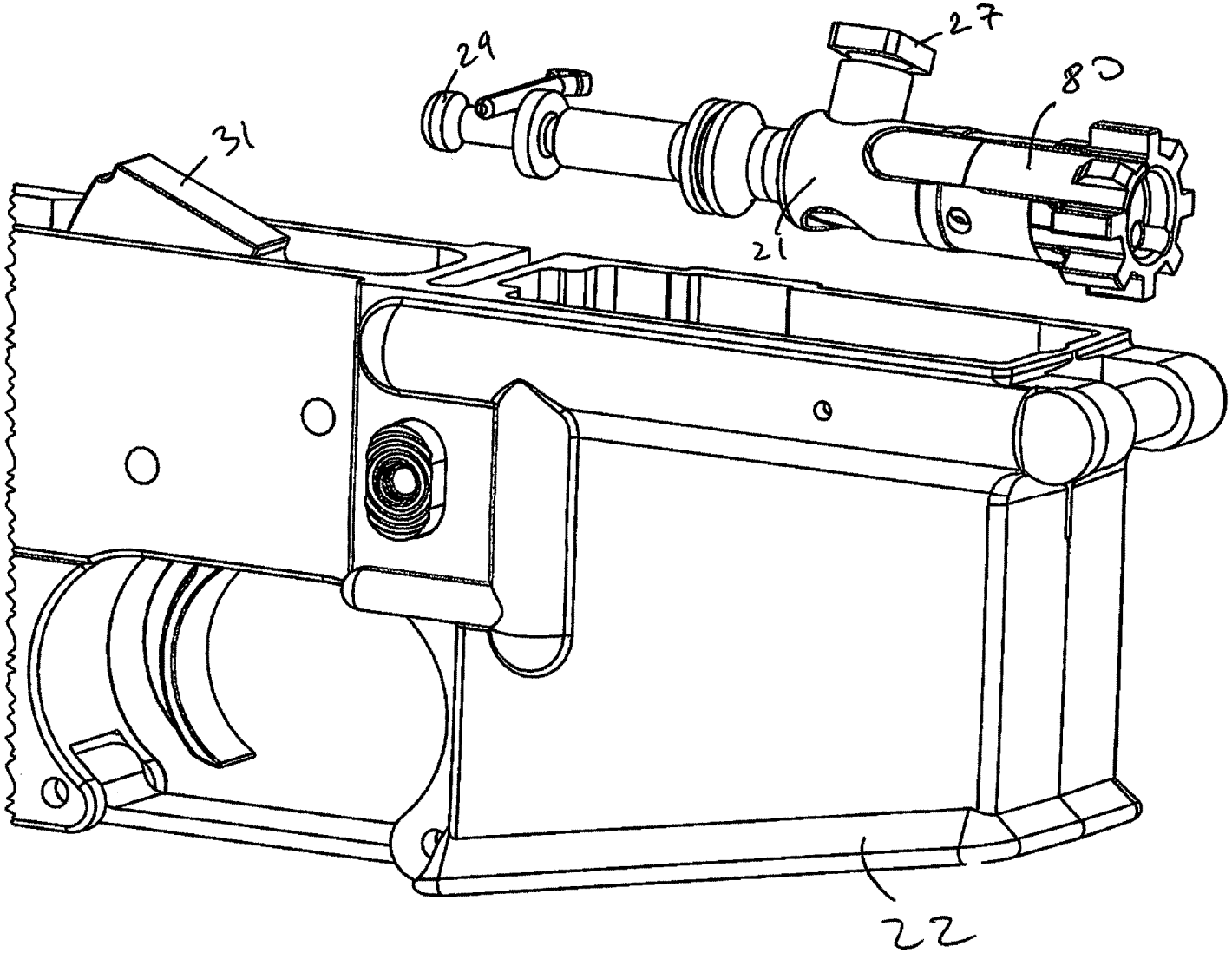
FIG. 19 depicts another partial view of a firearm according to some embodiments presently disclosed.
Figure 20:
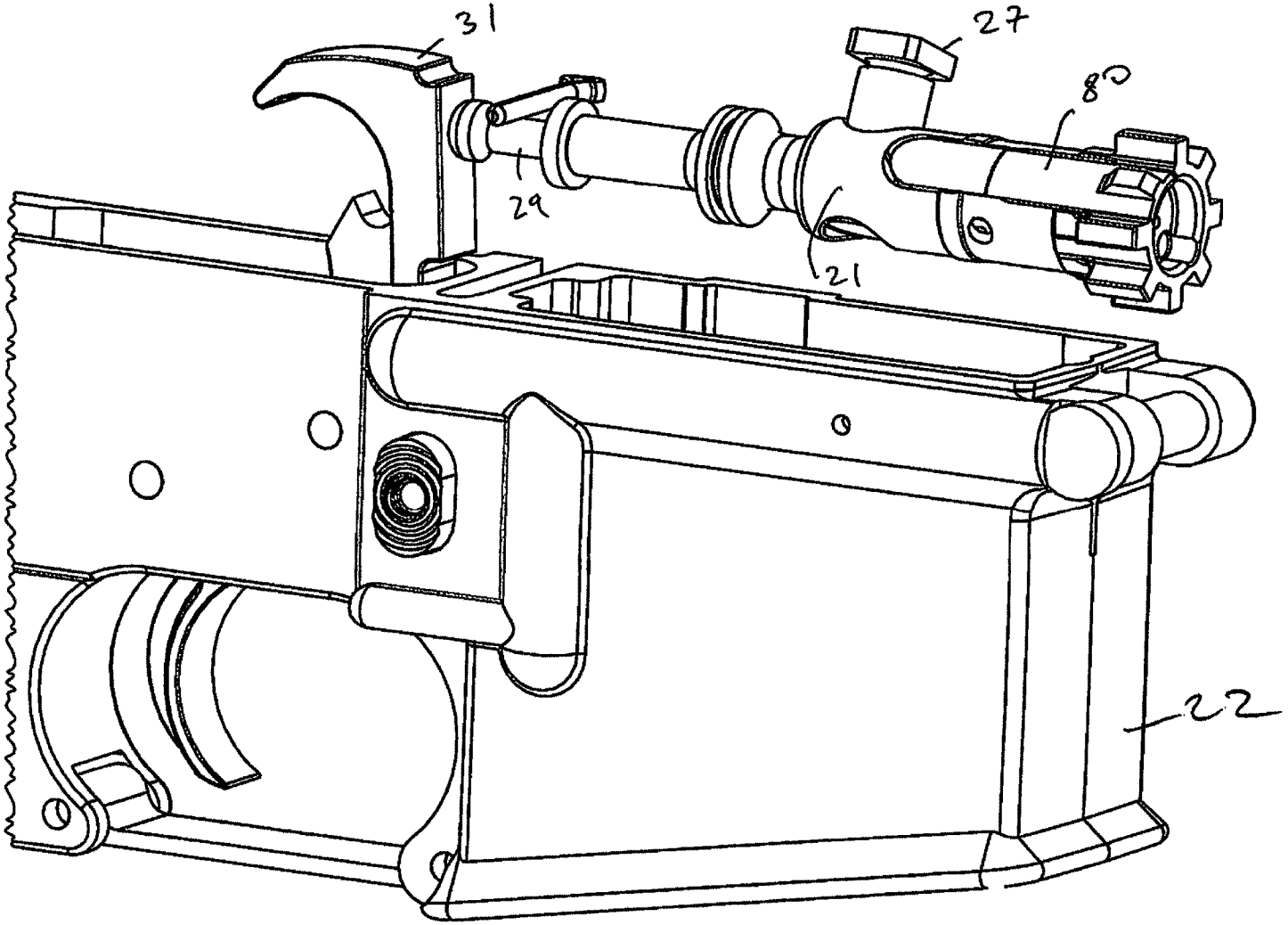
FIG. 20 depicts another partial view of a firearm according to some embodiments presently disclosed.
Figure 21:
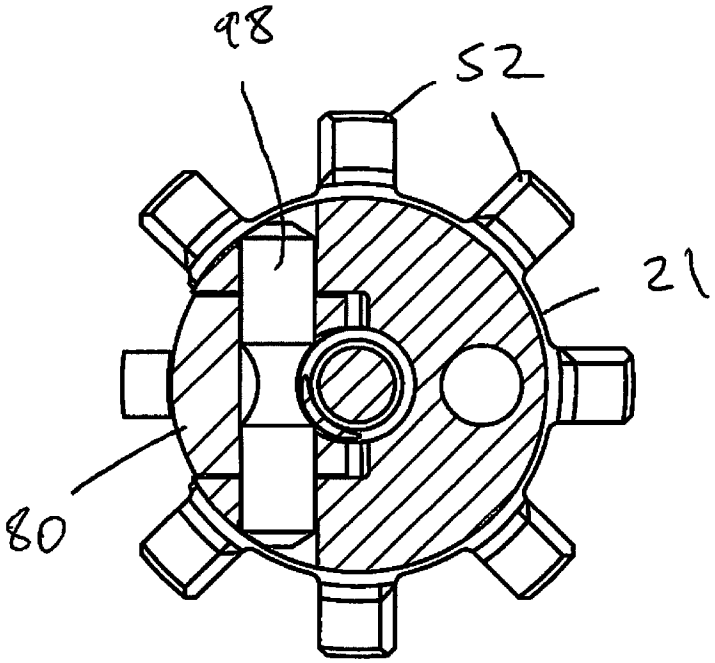
FIG. 21 depicts an assembly according to some embodiments presently disclosed.

Referring to FIGS. 17-20, when a trigger 101 is operated, a hammer 31 is released from its cocked position (shown in FIGS. 17 and 19) to travel through its motion path to a fired position (shown in FIGS. 18 and 20) resulting in contact with the rear (i.e. proximal end) of the firing pin 29 (shown in FIGS. 18 and 20). This causes the firing pin 29 to move from its rest position (shown in FIGS. 5, 12-13, and 15) forward against the force of the firing pin spring 110 (shown in FIGS. 6, 14, and 16) until the firing pin 29 is protruding far enough to ignite the primer of a loaded cartridge. As a result of the hammer 31 striking the proximal end of the firing pin 29, kinetic energy is transferred from the hammer 31 to the firing pin 29, which imparts this transferred energy to the primer of the loaded cartridge.

Referring to FIGS. 17-20, when the trigger 101 is returned back to its cocked position (shown in FIGS. 17 and 19), this causes the firing pin 29 to move rearward to its rest position (shown in FIGS. 5, 12-13, and 15) by the force of the firing pin spring 110 until the firing pin 29 is no longer protruding far enough to ignite the primer of a loaded cartridge.

Figure 8:
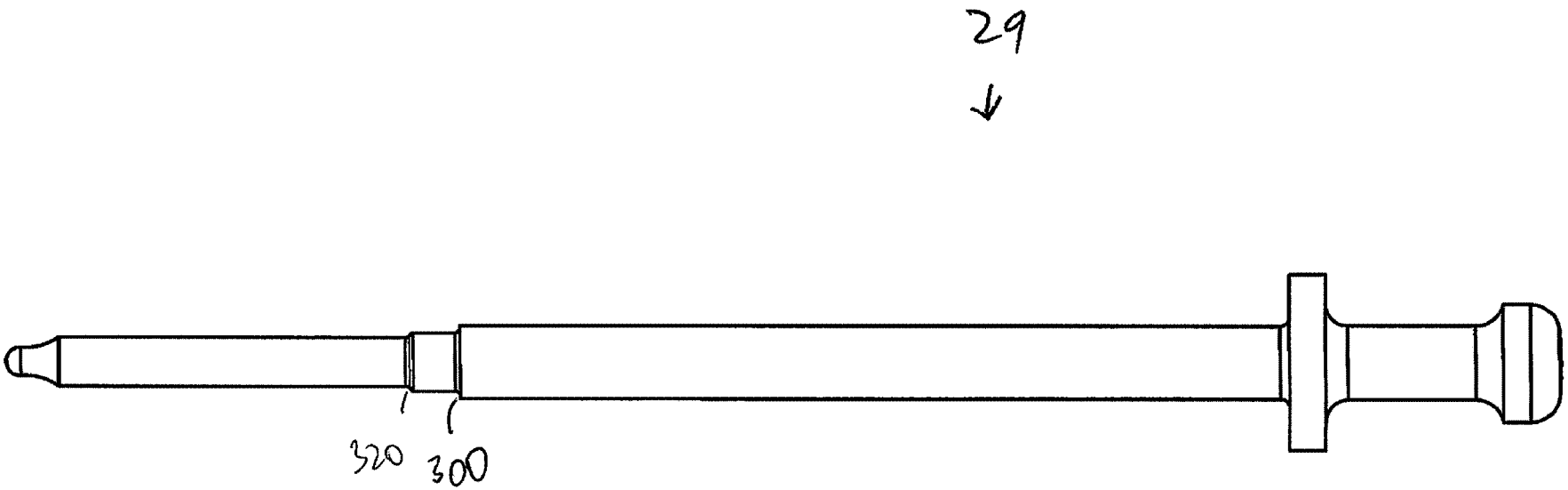
FIG. 8 depicts a side view of a firing pin according to some embodiments presently disclosed.
Figure 9:
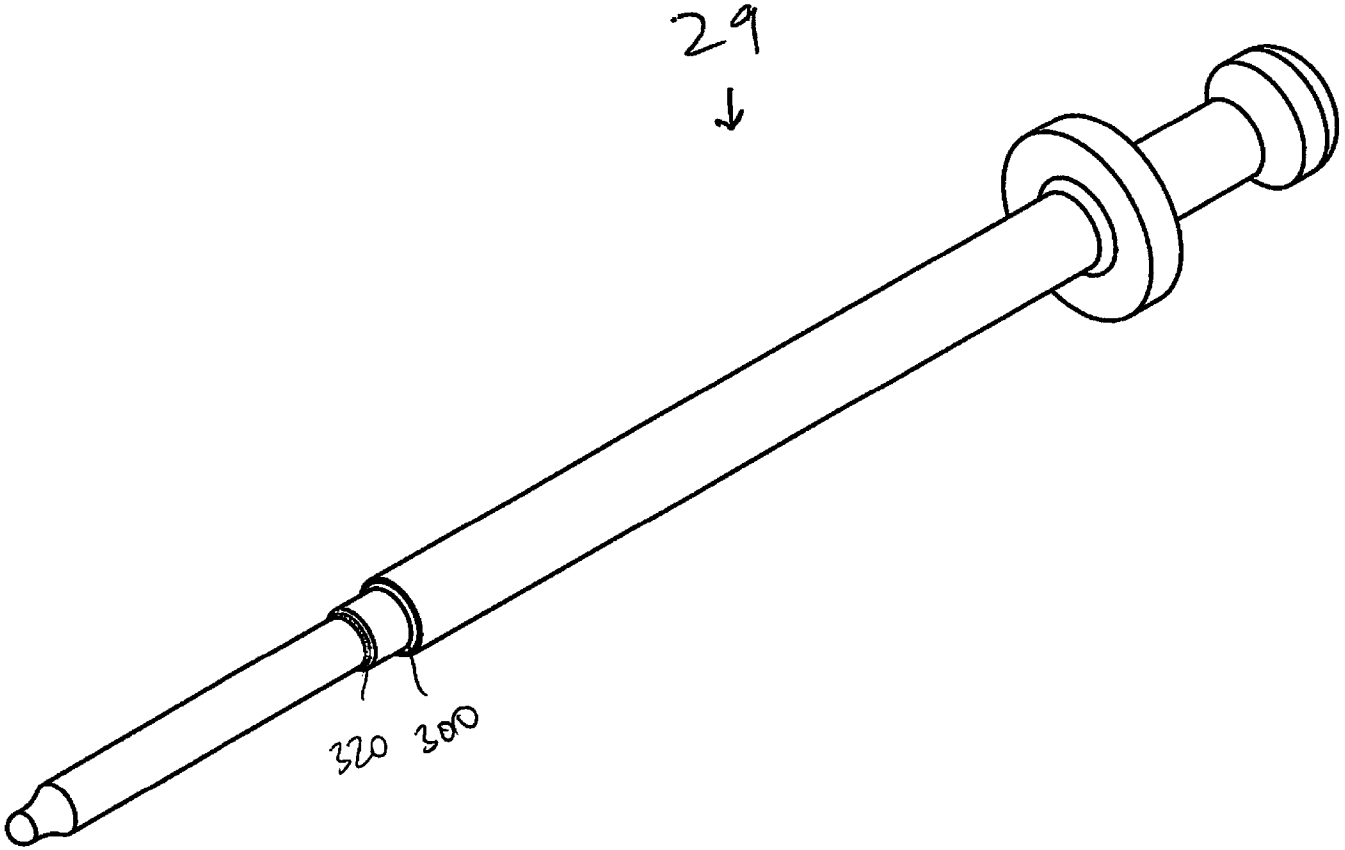
FIG. 9 depicts a perspective view of the firing pin according to some embodiments presently disclosed.

According to some embodiments, the firing pin 29 comprises a ledge 300 (shown in FIGS. 8-10). According to some embodiments, the firing pin spring 110 abuts the ledge 300 as shown in FIGS. 15-16. According to some embodiments, the firing pin 290 comprises a ledge 310 (shown in FIGS. 8-10). According to some embodiments, the firing pin spring 110 abuts the ledge 310.

According to some embodiments, the firing pin spring 110 causes the firing pin 29 to move rearward to its rest position by applying force to the ledge 300 until the firing pin 29 is no longer protruding far enough to ignite the primer of a loaded cartridge. According to some embodiments, the firing pin spring 110 causes the firing pin 290 to move rearward to its rest position by applying force to the ledge 310 until the firing pin 290 is no longer protruding far enough to ignite the primer of a loaded cartridge.

According to some embodiments, the firing pin 29 comprises another ledge 320 (shown in FIGS. 8-10). According to some embodiments, the ledge 320 is positioned within the firing pin spring 110 as shown in FIGS. 15-16.

Figure 22:
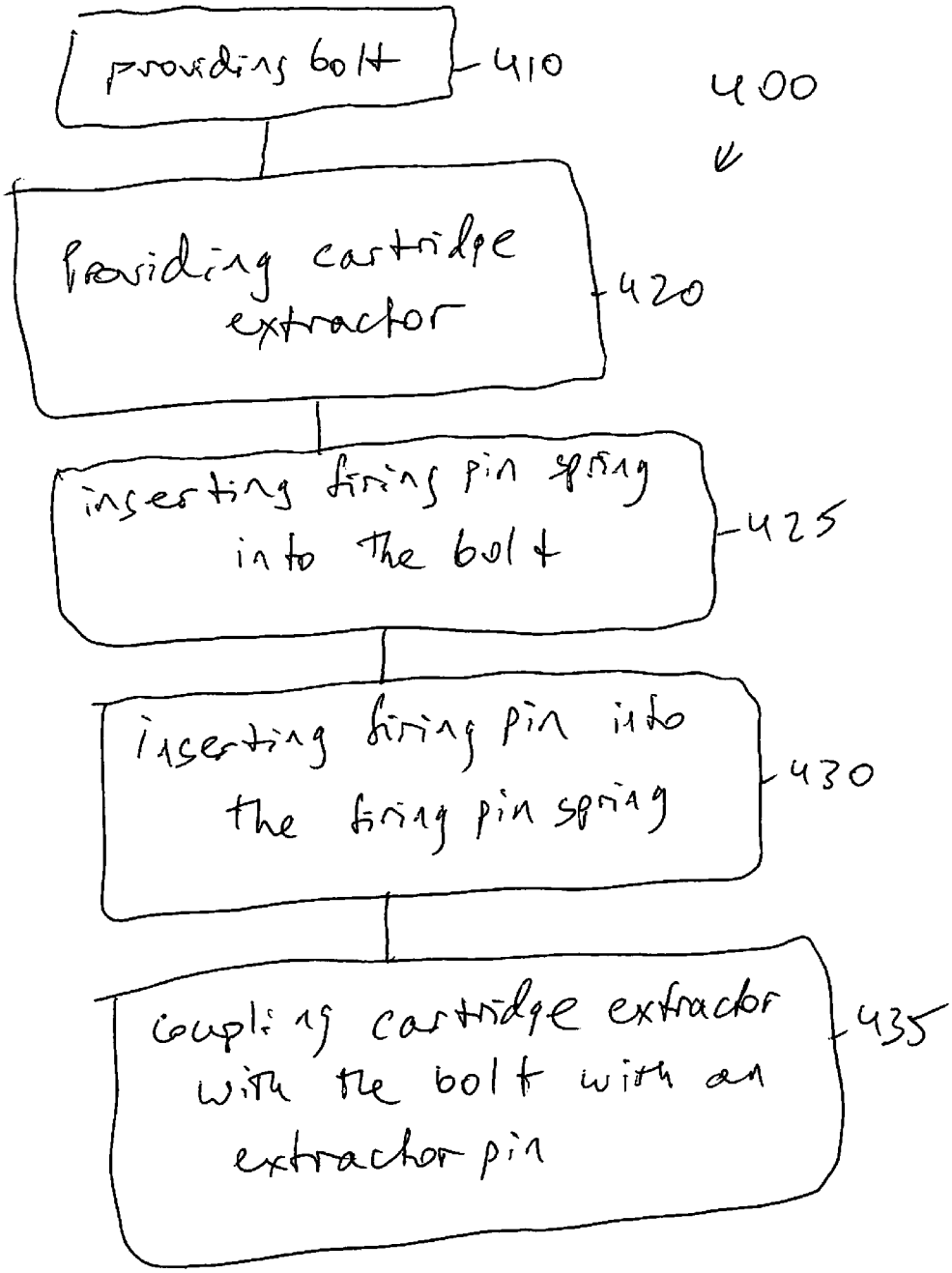
FIG. 22 depicts a process according to some embodiments presently disclosed.

Referring to FIG. 22, a process 400 is shown according to some embodiments presently disclosed. At 410, the bolt 21 is provided. At 420, the cartridge extractor 80 is provided. At 425, firing pin spring 110 is inserted into the aperture 90 of the bolt 21. At 430, firing pin 29 or 290 is inserted into the firing pin spring 110. At 435, the cartridge extractor 80 is coupled with the bolt 21 with the pin 98. Wherein the channel 100 of the pin 98 accommodates the firing pin 29 or 290 and accommodates the spring 110.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . ."

What is claimed is:

1. An assembly comprising:

an extractor pin configured to couple a cartridge extractor with a bolt, wherein the extractor pin comprises a channel; and a firing pin spring configured to accommodate a firing pin;

wherein the channel is configured to contain the firing pin spring when the cartridge extractor is coupled with the bolt by the extractor pin.

2. The assembly of claim 1 further comprising the bolt, wherein the bolt comprises an aperture configured to accommodate the firing pin spring.

3. The assembly of claim 2 further comprising the extractor coupled with the bolt by the extractor pin.

4. The assembly of claim 2 further comprising the firing pin, wherein the firing ping comprises a ledge; wherein the firing pin spring abuts the ledge.

5. A method comprising:

providing a bolt;

providing a cartridge extractor;

installing a firing pin spring into the bolt;

installing a firing pin into the bolt, wherein the firing pin spring is positioned between the firing pin and the bolt; and coupling the cartridge extractor with the bolt using an extractor pin, wherein the extractor pin comprises a channel, wherein the firing pin spring is positioned within the channel.

* * * * *